US006336808B1

(12) United States Patent
Schweikert

(10) Patent No.: US 6,336,808 B1
(45) Date of Patent: Jan. 8, 2002

(54) PROCESS FOR MANIPULATING WORKPIECES AND A ROTATING HEARTH FURNACE FOR THE SAME

(75) Inventor: Karlheinz Schweikert, Buerstadt (DE)

(73) Assignee: Karl Heess GmbH & Co. Maschinenbau, Lampertheim (DE)

( * ) Notice: Subject to any disclaimer, the term of this patent is extended or adjusted under 35 U.S.C. 154(b) by 0 days.

(21) Appl. No.: 09/676,773

(22) Filed: Oct. 2, 2000

(30) Foreign Application Priority Data

Oct. 1, 1999 (DE) ..... 199 47 482

(51) Int. Cl.[7] ..... F27B 9/16

(52) U.S. Cl. ..... 432/138; 432/141; 432/195; 414/160

(58) Field of Search ..... 432/138, 139, 432/141, 124, 142, 195; 414/160–162

(56) References Cited

U.S. PATENT DOCUMENTS 2,499,926 A * 3/1950 Lloyd ..... 432/138
3,741,553 A * 6/1973 Moore ..... 432/124
4,602,904 A * 7/1986 Jeffreys ..... 432/138
5,290,999 A * 3/1994 Kuster et al. ..... 432/124

FOREIGN PATENT DOCUMENTS

DE 298 08 569 9/1996

OTHER PUBLICATIONS

"Drehherdofenanlage zum Gasaufkohlen mit anschliessender Pressenhärtung", Th. Wienstroth Und K. Ritzka, HTM vol. 44 (1989), pp. 121–124 (with translation).
"Technische Mitteilungen", vol. 57, 1964, pp. 199–200 (with translation).

* cited by examiner

*Primary Examiner*—Gregory Wilson
(74) *Attorney, Agent, or Firm*—Jacobson Holman, PLLC

(57) ABSTRACT

A process for manipulating workpieces, which are to be carburized, wherein the workpieces or workpiece magazines that are to be deposited on pallets are loaded in several rows, corresponding to a predefined number of rows of workpieces, into a rotating hearth furnace and, after carburization, are removed from the rotating hearth furnace and fed to a hardening press, exhibiting a predetermined number of press stations, and wherein on each pallet are deposited a number of workpieces or workpiece magazines, said number corresponding to the number of press stations. For better utilization of the capacity of the rotating hearth furnace and the hardening press, the pallets in the rotating hearth furnace are arranged in such a number of rows that the number of press stations is a divisor of the number of workpiece rows.

4 Claims, 3 Drawing Sheets

PROCESS FOR MANIPULATING WORKPIECES AND A ROTATING HEARTH FURNACE FOR THE SAME

BACKGROUND OF THE INVENTION (1) Field of the Invention

The invention relates to a process for manipulating workpieces, which are to be carburized. In this process the workpieces or workpiece magazines that are to be deposited on a pallet are loaded in several rows, corresponding to a predefined number of rows of workpieces, into a rotating hearth furnace. Then after carburization they are removed from the rotating hearth furnace and fed to a hardening press, exhibiting a predetermined number of press stations, and on each pallet are deposited a number of workpieces or workpiece magazines, the number corresponding to the number of press stations.

(2) Description of the Related Art

During the thermal treatment of the workpieces as mass production parts for case hardening, different types of furnaces are used as a function of the quantity and size of the workpieces. Small or thin-walled workpieces, such as synchronous rings or gearshift sleeves for motor vehicle gear shifts, can be heated in a rotating hearth furnace in a relatively short period of time and processed to a sufficient hardness penetration depth ranging from approximately 0.2 to 0.3 mm. For complete utilization of the furnace chamber and to obtain many hours of carburization, the workpieces to be carburized are usually positioned on single pallets in multilayered grate systems. They are put with the loaded "green parts", that is workpiece blanks that have not been carburized yet, into the rotating hearth furnace. After carburization, they are removed from the furnace and fed to a hardening press, exhibiting a predetermined number of press stations. The number of workpieces, to be deposited on each pallet, is defined by the number of press stations (press station number) in the hardening press.

In designing a workpiece hardening system, comprising essentially a rotating hearth furnace and a hardening press, it is important that the capacity of both the furnace and the press is utilized in such a manner that there are no idle times. To this end, the pallets are arranged in a circular row in the rotating hearth furnace. At one charging site of the rotating hearth furnace, a pallet or workpiece magazines with already carburized workpieces is/are removed, and the rotating hearth furnace is loaded with a pallet of green compacts.

It is known from German utility model 269 08 569 to load a pallet, instead of with individual workpieces, with one or several workpiece magazines, where several workpieces are stacked in each workpiece magazine.

BRIEF SUMMARY OF THE INVENTION

The invention is based on the problem of designing the aforementioned manipulation in such a manner that the capacity of both the rotating hearth furnace and the hardening press can be better utilized. To this end the invention provides that the pallets in the rotating hearth furnace are arranged in such a number of rows that the number of workpiece rows is a multiple of the number of press stations. The invention makes it possible to couple, for example, smaller hardening presses with few press stations with larger rotating hearth furnaces, in which a larger number of workpiece rows can be accommodated, because there is no longer any need to maintain the same number of press stations as the number of workpiece rows. Thus, smaller hardening presses can be coupled with larger rotating hearth furnaces as a function of the respective carburization time without incurring any idle times.

Special embodiments of the invention are disclosed in the dependent claims.

In the following the invention is explained in detail with reference to the attached drawings.

DETAILED DESCRIPTION OF THE INVENTION

Figure 1:
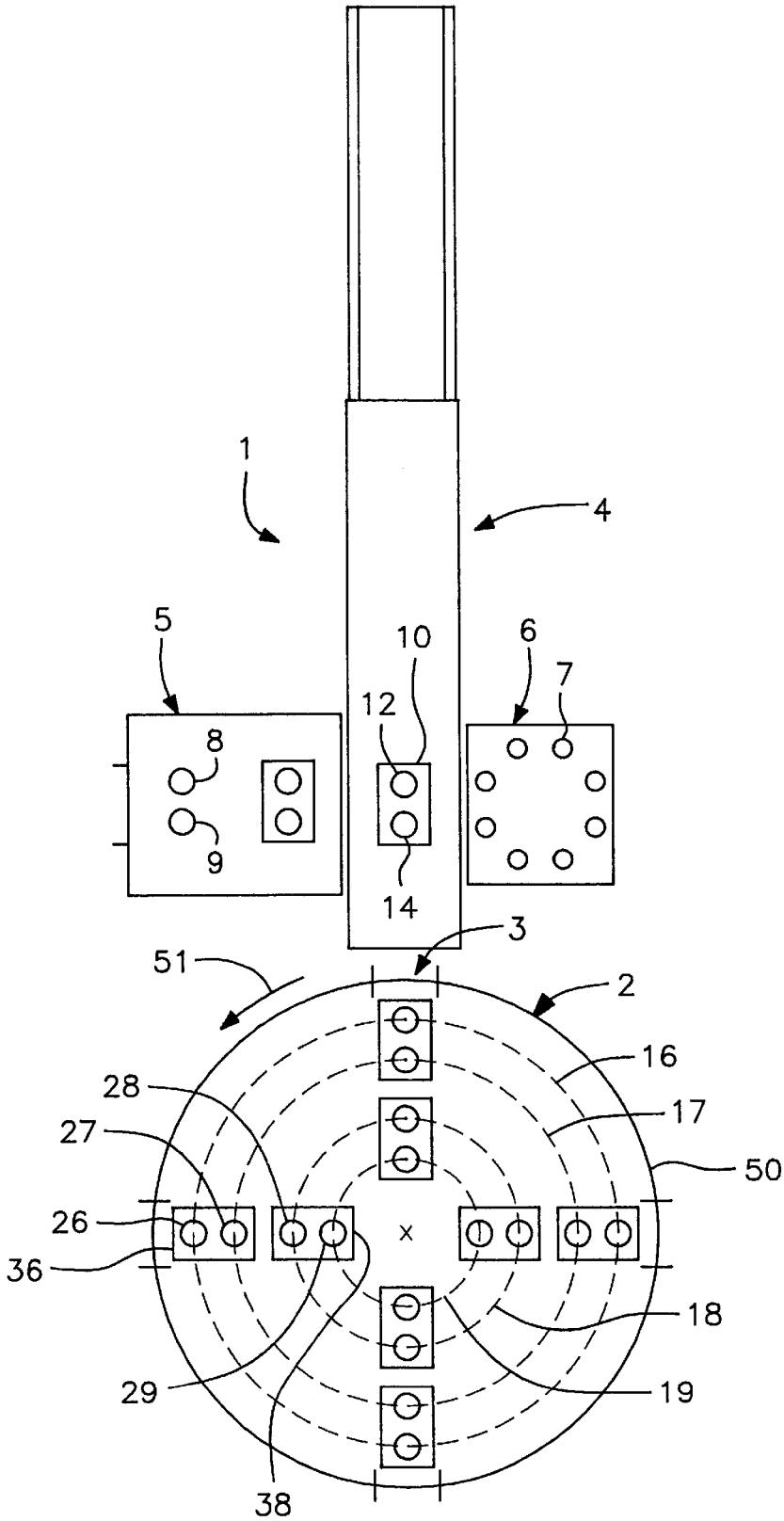
FIG. 1 is a top view of a schematic drawing of a workpiece hardening system with a hardening press exhibiting two press stations.
Figure 2:
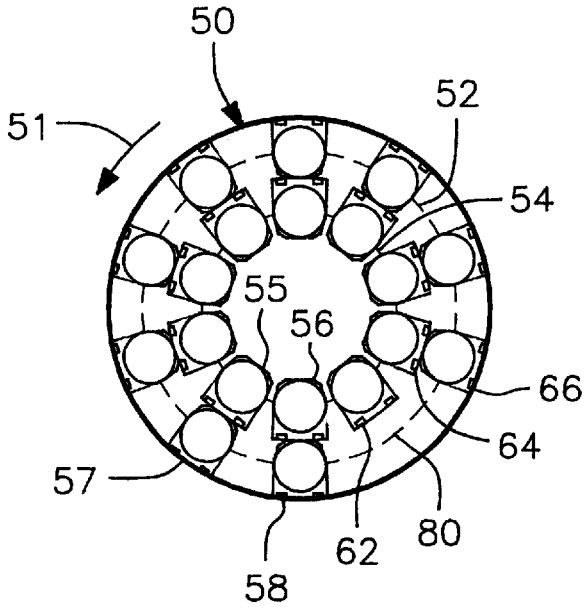
FIGS. 2 to 9 depict various stages of the pallet removal and charging procedure at a rotating hearth furnace, according to FIG. 1.

In front of the charging hole 3 of a rotating hearth furnace 2 there is a manipulator 4 of a workpiece hardening system, all of which is marked with the reference numeral 1. Next to said workpiece hardening system there is a hardening press 5 on one side and on the opposite side there is a magazine 6 with a supply of green compacts 7. The manipulator 4 is designed in such a manner that the pallet 10, which carries two workpieces 12, 14 in the elucidated example, has room on its arm (not illustrated). Instead of two workpieces 12, 14, two workpiece magazines can be deposited on the pallet 10. The hardening press 5 is equipped with two press stations 8, 9 so that in one press step two carburized workpieces or two workpiece magazines with carburized workpieces can be processed simultaneously. A quenching station, which usually precedes the hardening press 5 and which is intended for the carburized, hot workpieces, is not illustrated.

The rotating hearth furnace 2 has several levels with concentrically stacked, circular grates, on which the pallets, such as the pallet 10, can be deposited and from which the pallets can be removed, when they are exactly behind the charging hole 3. Each pallet 10 carries as many workpieces 12, 14 or workpiece magazines, in the present case two, as the hardening press can simultaneously process, thus a number of workpieces or workpiece magazines that is equal to the number of press stations. Therefore, the grate levels carry pallets in concentric rows. The arm of the manipulator 4 can place the pallets on each grate level through the charging hole 3 and remove the pallets from said hole. For the sake of a better overview, only one single grate level is shown in the figures.

Moreover, there are means (not illustrated) for removing green compacts 7 in the magazine 6 and for depositing them on an empty pallet and there are means for removing the workpieces 12, 14 or the workpiece magazines from the pallet 10 for delivering the same into the quenching device and for feeding them from there between the compacting tools of the hardening press 5.

FIG. 1 shows a workpiece hardening system 1, where the manipulator 4 serves a rotating hearth furnace 2, on whose grate level there is room for four concentric rows of workpieces 16, 17, 18, 19, and a hardening press 5 with two press stations 8, 9. The workpieces or the workpiece magazines 26, 27 of the workpiece rows 16 and 17 are located on one single pallet 36; said workpieces or workpiece magazines lie on the same radius. The other two workpieces or workpiece magazines 28 and 29 of the workpiece rows 18 and 19 are located on another pallet 38; said workpieces or workpiece magazines that lie next to each other further toward the inside lie on the same radius. Thus, both pallets 36 and 38 lie essentially on the same radius. For the sake of a better overview, FIG. 1 depicts only four pairs of opposing pairs of pallets on the grate levels shown. In fact, a grate level usually has many more pallets, arranged in concentric rows. In the present case the two rows of pallets, to which the pallets 36 and 38 belong, comprise the four rows of workpieces 16, 17, 18 and 19. It is evident that the number of rows of workpieces is a multiple, here twice, the number of press stations, here the two press stations 8 and 9.

If the two pallets 36 and 38 lie one after the other at the charging hole 3, it is necessary for the purpose of removing the inside pallet 38 and to replace it with a pallet loaded with green compacts only to provide space, which is not occupied with a pallet, in the main direction of rotation 51 of the grate 50 next to the outside pallet 36 and to equip the grate drive with a switching device for reversing the direction of rotation for a short period of time for the grate. This feature is explained below with reference to a simple embodiment depicted in FIGS. 2 to 9. In this embodiment the manipulator 4 serves a hardening press with a press station and a rotating hearth furnace with two rows of workpieces.

Since the number of workpieces or workpiece magazines, accommodated on a pallet, must be equal to the number of press stations, each pallet carries here only one single workpiece or workpiece magazine. The main direction of rotation of the grate 50 is marked with the reference numeral 51. Thus, it points in the counter-clockwise direction. Two concentric rows 52, 54, on which pallets are deposited, are accommodated on the grate 50. Since each pallet carries one single workpiece or workpiece magazine, they equal the number of rows of workpieces. In detail, each pallet 55 or 57 carries a workpiece or a workpiece magazine that is just about at the end of its carburization time. Each of the pallets 56, 58 carries a completely carburized workpiece or workpiece magazine; and each of the pallets 62, 64, 66 carries a workpiece or workpiece magazine that still needs to be carburized. The pallets 55, 57 are standing just in front of, the pallets 56, 58 precisely at and the pallets 62, 64, 66 in the main direction of rotation behind the charging hole. Radially in front of the pallet 62 is a free space 80 on the grate 50. This free space has no pallet.

Figure 3:
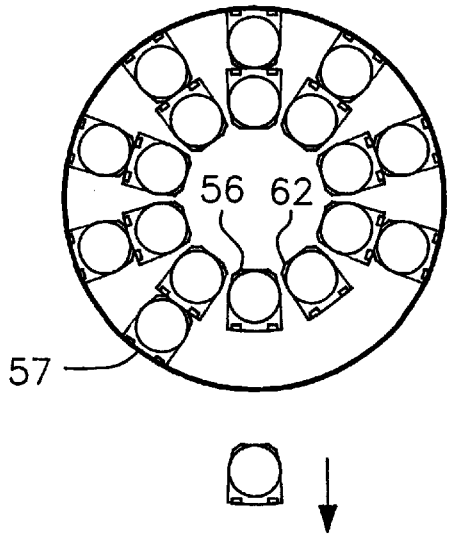
Figure 4:
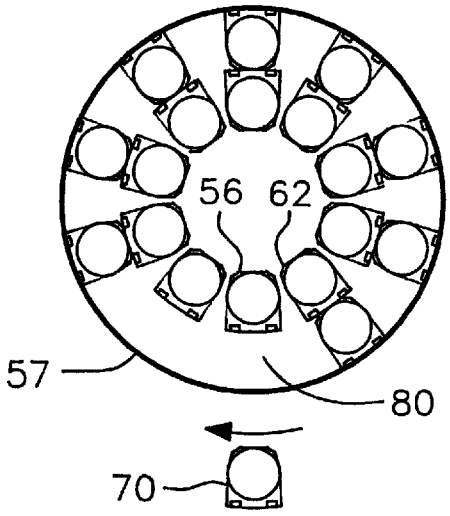
Figure 5:
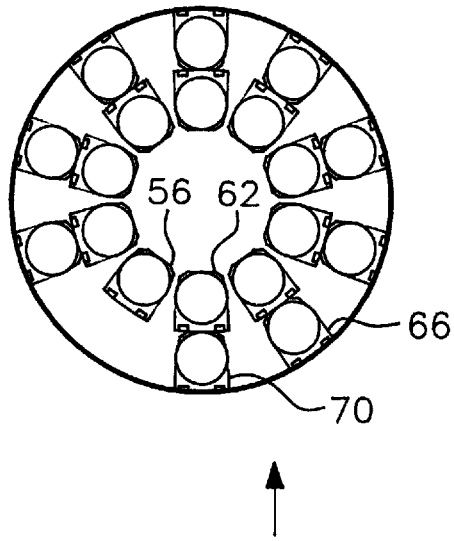
Figure 6:
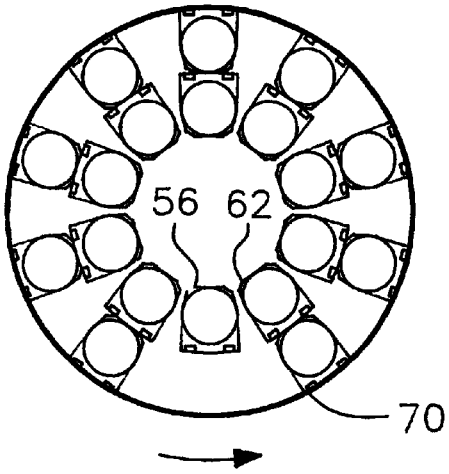
Figure 7:
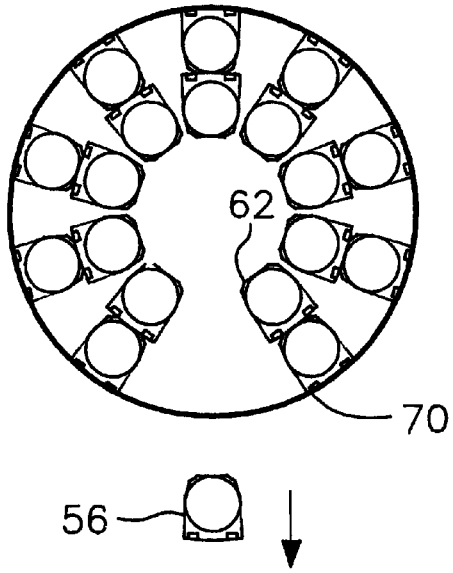
Figure 8:
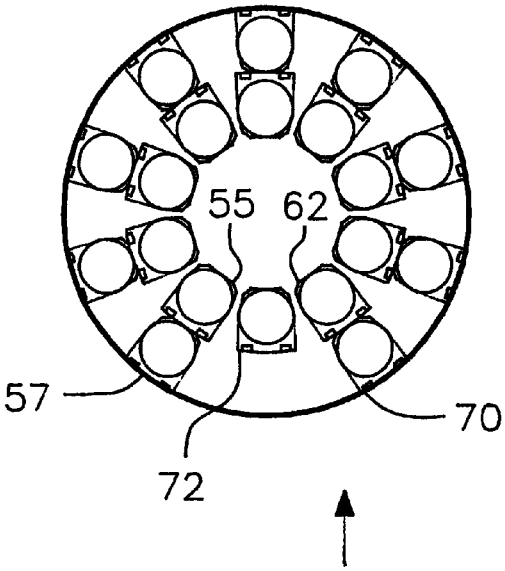
Figure 9:
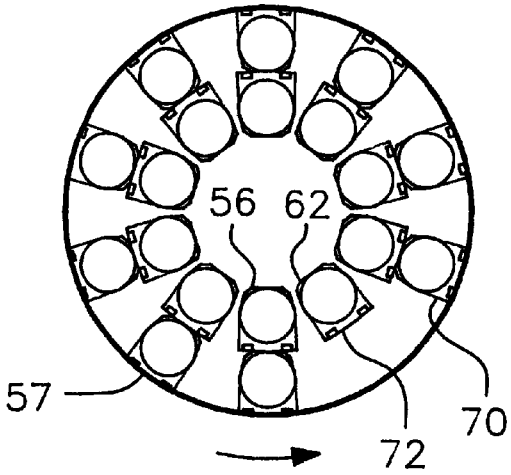

First, the arm of the manipulator 4 removes the pallet 58 (FIG. 3). Then the grate drive's direction of rotation is reversed until the inside pallet 62, neighboring in the main direction of rotation 51 the inside pallet 56, is behind the charging hole. Then the grate drive is stopped and the free space 80 is filled by the arm with a pallet 70, which carries a green compact (FIGS. 4 and 5). Then the grate 50 continues to rotate in the main direction of rotation 51 until the inside pallet 56 is accessible to the arm through the charging hole (FIG. 6). The arm removes the pallet 56 from the grate 50 and replaces it with a pallet 72, which carries a green compact (FIGS. 7 and 8). Finally the grate 50 is driven in the main direction of rotation until the next pair of pallets 55, 57 with workpieces that have been completely carburized in the meantime is accessible. A state of grate loading with pallets is reached. This state matches the starting condition according to FIG. 2.

Correspondingly it is possible to couple a rotating hearth furnace with n possible workpiece rows with a hardening press, which has only a number of press stations that is a real divisor of n in the mathematical sense, when there is a sufficient number of free spaces. If a rotating hearth furnace enables, for example, six workpiece rows per grate, it can be coupled either to a hardening press with two press stations or with a hardening press with three press stations, whereby two or three rows of pallets are accommodated in the rotating hearth furnace. If three rows of workpieces per grate are possible, then a hardening press with one press station is adequate.

What is claimed is:

1. Process for manipulating workpieces, which are to be carburized, wherein the workpieces or workpiece magazines that are to be deposited on pallets are loaded in several rows, corresponding to a predefined number of rows of workpieces, into a rotating hearth furnace; and, after carburization, removed from the rotating hearth furnace and fed to a hardening press, exhibiting a predetermined number of press stations, and wherein on each pallet are deposited a number of workpieces or workpiece magazines, said number corresponding to the number of press stations, and wherein the pallets in the rotating hearth furnace are arranged in such a number of rows that the number of workpiece rows is a multiple of the number of press stations.

2. Process, as claimed in claim 1, wherein, next to the pallets, which lie on the same radius and are to be removed from the rotating hearth furnace, there is at least one free space, which is not occupied by a pallet.

3. Rotating hearth furnace with one or more stacked grate levels, wherein several concentric rows of pallets, occupied by workpieces or workpiece magazines, are arranged on each grate, and wherein at least one row of pallets exhibits at least one free space that is not occupied by a pallet, and wherein each said grate is rotatable in forward and reverse directions such that during removal/replacement of a pallet, a free space in said row of pallets will always exist.

4. Rotating hearth furnace with one or more stacked grate levels, wherein several concentric rows of pallets, occupied by workpieces or workpiece magazines, are arranged on each grate, and wherein at least one row of pallets exhibits at least one free space that is not occupied by a pallet, wherein each pallet carries a number of workpieces or workpiece magazines, which is equal to the number of press stations of a hardening press, assigned to the rotating hearth furnace.

* * * * *